US011164493B2

(12) United States Patent
Kim et al.

(10) Patent No.: US 11,164,493 B2
(45) Date of Patent: Nov. 2, 2021

(54) DATA PROCESSING DEVICE, DATA DRIVING DEVICE, AND SYSTEM FOR DRIVING DISPLAY DEVICE

(71) Applicant: SILICON WORKS CO., LTD., Daejeon (KR)

(72) Inventors: Do Seok Kim, Daejeon (KR); Hyun Kyu Jeon, Daejeon (KR); Yong Hwan Mun, Daejeon (KR); Myung Yu Kim, Daejeon (KR)

(73) Assignee: Silicon Works Co., Ltd., Daejeon (KR)

( * ) Notice: Subject to any disclaimer, the term of this patent is extended or adjusted under 35 U.S.C. 154(b) by 13 days.

(21) Appl. No.: 16/717,415

(22) Filed: Dec. 17, 2019

(65) Prior Publication Data

US 2020/0193884 A1 Jun. 18, 2020

(30) Foreign Application Priority Data

Dec. 18, 2018 (KR) ..... 10-2018-0163811

(51) Int. Cl.
*G09G 5/00* (2006.01)
*G09G 3/00* (2006.01)

(52) U.S. Cl.
CPC ..... *G09G 3/006* (2013.01); *G09G 2310/0272* (2013.01); *G09G 2310/08* (2013.01)

(58) Field of Classification Search
CPC ..... G09G 2310/08; G09G 2310/027; G09G 2330/021; G09G 3/2096; G09G 3/3685; G09G 2330/12; G09G 2370/10; G09G 2370/14; G09G 2310/0264; G09G 2310/0275; G09G 2370/00; G09G 2310/0243; G09G 2310/0272; G09G 2310/0289; G09G 2310/0297; G09G 2310/061; G09G 2330/08; G09G 2370/04; G09G 3/3275; G09G 5/006; G09G 2370/08; G09G 5/008; G09G 2300/0426; G09G 2310/0278; G09G 2310/0286; G09G 2310/0291; G09G 3/006; G09G 3/2092
USPC ..... 345/98–100
See application file for complete search history.

(56) References Cited

U.S. PATENT DOCUMENTS 9,837,037 B2 12/2017 Hwang et al.
9,882,746 B2 1/2018 Lukanc et al.
10,861,375 B2 * 12/2020 Lim ..... G09G 5/008
2016/0232874 A1 * 8/2016 Matsuda ..... G09G 5/008

FOREIGN PATENT DOCUMENTS

KR 10-0958726 B1 4/2009

* cited by examiner

*Primary Examiner* — Duc Q Dinh
(74) *Attorney, Agent, or Firm* — Fenwick & West LLP

(57) ABSTRACT

The present embodiment relates to a technique for speeding up data communication in a display device and provides a technique for transmitting and receiving at least some information using a communication line indicating a clock training state and for automatically optimizing the configuration of an equalizer in a receiving device.

20 Claims, 18 Drawing Sheets

DATA PROCESSING DEVICE, DATA DRIVING DEVICE, AND SYSTEM FOR DRIVING DISPLAY DEVICE

CROSS REFERENCE TO RELATED APPLICATION

This application claims priority from Korean Patent Application No. 10-2018-0163811, filed on Dec. 18, 2018, which is hereby incorporated by reference for all purposes as if fully set forth herein.

BACKGROUND OF THE INVENTION

1. Field of the Invention

The present embodiment relates to a technique for driving a display device.

2. Description of the Prior Art

A display panel includes a plurality of pixels arranged in a matrix form, and each pixel includes sub-pixels such as R (red), G (green), B (blue), and the like. The respective sub-pixels emit light in grayscale according to image data to display an image on a display panel.

Image data is transmitted from a data processing device called a "timing controller" to a data driving device called a "source driver". The image data is transmitted in digital values, and the data driving device converts the image data into analog voltages to drive respective pixels.

Since the image data indicates the grayscale value of each pixel individually or independently, the amount of the image data increases as the number of pixels arranged in the display panel increases. In addition, as a frame rate increases, the amount of image data to be transmitted in unit time increases.

Recently, as the resolution of the display panel becomes higher, both the number of pixels and the frame rate of the display panel are increasing, and in order to process the increased amount of image data due to the high resolution, a high-speed data communication is required for the display device.

SUMMARY OF THE INVENTION

In this background, an aspect of the present embodiment is to provide a technique for speeding up data communication in a display device. Another aspect of the present embodiment is to provide a technique for transmitting information, which is able to be transmitted through an existing main communication line, through an auxiliary communication line. Another aspect of the present embodiment is to provide a technique for more effective data communication through a main communication line by transmitting and receiving information through an auxiliary communication line before communication through a main communication line is established. Another aspect of the present embodiment is to provide a technique for transmitting and receiving at least some information through a lock communication line for checking a clock training state. Another aspect of the present embodiment is to provide a technique for automatically optimizing the setting of an equalizer in a receiving device.

In view of the foregoings, an embodiment provides a data driving device including: a first communication unit including an equalizer and configured to receive a first communication signal through a first communication line, to restore a first clock using the first communication signal, and to receive image data included in the first communication signal according to the first clock; a second communication unit configured to transmit and receive a second communication signal through a second communication line and transmit a training state of the first clock or receive equalizer (EQ) test information on the equalizer through the second communication signal; and a controlling unit configured to control setting of the equalizer according to the EQ test information, evaluate the reception performance of the first communication unit using the EQ test signal received through the first communication line for each setting state of the equalizer, and determine an optimal setting for the equalizer according to an evaluation result.

In the data driving device, the EQ test information may include a set value for a gain of the equalizer.

In the data driving device, the EQ test signal may include a clock pattern, the first communication unit may restore a first clock using the clock pattern, and the controlling unit may evaluate the reception performance of the first communication unit using a result of the restoration of the first clock.

In the data driving device, the EQ test signal may include link data, the first communication unit may receive the link data according to the first clock, and the controlling unit may evaluate the reception performance of the first communication unit by a reception rate of a plurality of symbols included in the link data.

In the data driving device, the link data may include a plurality of direct current (DC)-balanced zero symbols, and the controlling unit may evaluate the reception performance of the first communication unit by a reception rate of the plurality of zero symbols.

In the data driving device, the plurality of zero symbols may be scrambled.

In the data driving device, wherein the link data may include a plurality of first type symbols and a plurality of second type symbols, the first communication unit may restore a symbol clock using the plurality of first type symbols and receive the plurality of second type symbols according to the symbol clock, and the controlling unit may evaluate the reception performance of the first communication unit by a reception rate of the plurality of second type symbols.

In the data driving device, the EQ test signal may be received by the frame time unit.

In the data driving device, wherein the EQ test signal may include a clock pattern and link data, the link data may include a plurality of first type symbols and a plurality of second type symbols, and the first communication unit may receive the clock pattern and the plurality of first type symbols during a frame blank time period of each frame and receive the plurality of second type symbols during a frame active time period of each frame.

In the data driving device, the EQ test signal may be received by the unit of 1/N of a frame active time period (N is a natural number of 2 or higher), and the first communication unit may receive a total of N EQ test signals.

In the data driving device, the EQ test signal may include a clock pattern and link data, the link data may include a plurality of first type symbols and a plurality of second type symbols, and the first communication unit may receive the clock pattern and the plurality of first type symbols during 1/(2N) of a frame active time period and receive the plurality of second type symbols during the other 1/(2N) of a frame active time period.

In the data driving device, the controlling unit may configure the equalizer at an intermediate value of a plurality of setting states evaluated as higher reception performance.

In the data driving device, the controlling unit may determine an optimal set value for the equalizer and transmit the determined set value to another device through the second communication signal.

In the data driving device, the second communication unit may receive a plurality of pieces of the EQ test information indicating different set values respectively during different time periods, and the first communication unit may receive each of the EQ test signals during a time period subsequent to the time period during which each piece of the EQ test information is received.

In the data driving device, the first communication unit may receive the EQ test signal within a time period before receiving the image data after starting, and the controlling unit may determine an optimal setting for the equalizer before the image data is received.

In the data driving device, the second communication unit may receive a state check command through the second communication signal before receiving the EQ test information and change the voltage level of the second communication line for a predetermined time in response to the state check command.

In the data driving device, the second communication unit may operate in a lock mode in which the training state of the first clock is transmitted and in a communication mode in which the second communication signal is transmitted and received.

Another embodiment provides a data processing device including: a controlling unit configured to process image data; a first communication unit configured to include the image data in a first communication signal containing a first clock and transmit the first communication signal to a data driving device connected thereto through a first communication line; and a second communication unit configured to transmit and receive a second communication signal to the data driving device through a second communication line and check a training state of the data driving device with respect to the first clock or transmit equalizer (EQ) test information on an equalizer of the data driving device through the second communication signal, wherein the controlling unit may be configured to perform control such that the second communication unit transmits the EQ test information through the second communication signal and the first communication unit transmits an EQ test signal through the first communication signal in response to the transmission of the EQ test information.

In the data processing device, the second communication line may include a common bus of a single signal line, and a plurality of data driving devices may be connected to the second communication line.

In the data processing device, a pull-up resistor may be connected to the second communication line, and the second communication unit may control the signal voltage of the second communication line through a switch controlling a connection between the second communication line and a low-power source.

In the data processing device, the first communication line may be a differential signal line driven by a current, the second communication line may be a single signal line driven as an open drain, and a data rate of the first communication line may be higher than that of the second communication line.

In the data processing device, the EQ test information may include an identification number (ID) of the data driving device, which is configured by a plurality of pins.

In the data processing device, the EQ test signal may be transmitted by the unit of a frame time or by the unit of 1/N of a frame active time period (N is a natural number of 2 or higher).

In the data processing device, the controlling unit may repeat periodic operations in frame units.

Another embodiment provides a system including: a data processing device configured to transmit image data; and a plurality of data driving devices configured to drive pixels arranged in a panel according to the image data, wherein the data processing device and the plurality of data driving devices are connected one to one through a plurality of first communication lines, wherein the data processing device and the plurality of data driving devices are connected through a second communication line configured as a common bus, the data processing device transmits the image data containing a first clock through the first communication line, wherein the data driving device transmits the training state of the first clock through the second communication line, and wherein the data processing device transmits equalizer (EQ) test information on an equalizer of the data driving device through the second communication line and transmits an EQ test signal through the first communication line in response to the transmission of the EQ test information.

In the system, the data driving device may include an equalizer connected to first communication line, control setting of the equalizer according to EQ test information received through the second communication line, evaluate the reception performance of a signal with respect to the EQ test signal received through the first communication line for each setting state of the equalizer, and determine an optimal setting of the equalizer according to the evaluation result.

As described above, according to the present embodiment, data communication in the display device can be speeded up. In addition, according to the present embodiment, it is possible to transmit information, which is able to be transmitted through an existing main communication line, through an auxiliary communication line. In addition, according to the present embodiment, it is possible to provide more effective data communication through a main communication line by transmitting and receiving information through an auxiliary communication line before communication through the main communication line is established. In addition, according to the present embodiment, it is possible to transmit and receive at least some information through a lock communication line for checking a clock training state. In addition, according to the present embodiment, it is possible to automatically optimize the setting of an equalizer in a receiving device (e.g., a data driving device).

BRIEF DESCRIPTION OF THE DRAWINGS

The above and other aspects, features, and advantages of the present disclosure will be more apparent from the following detailed description taken in conjunction with the accompanying drawings, in which.

DETAILED DESCRIPTION OF THE EMBODIMENTS

Figure 1:
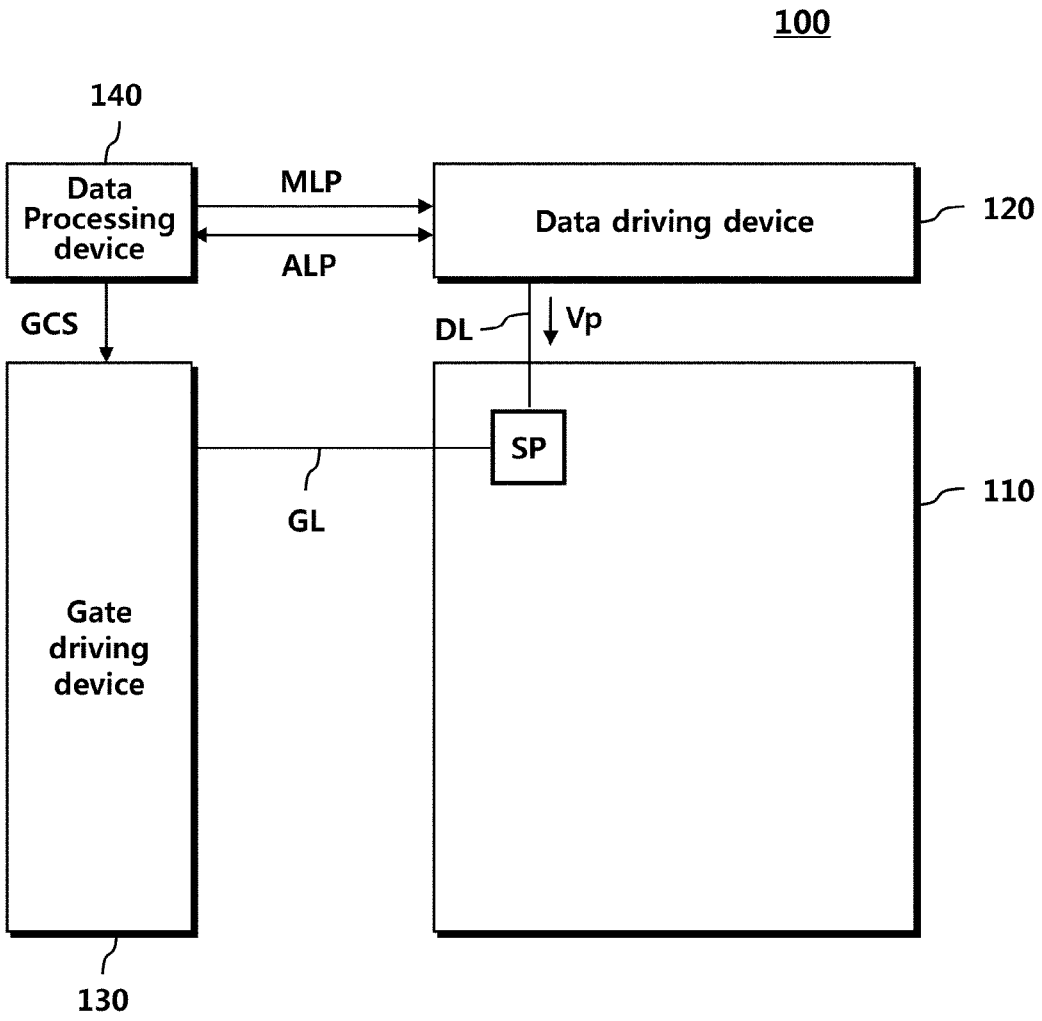
FIG. 1 is a diagram illustrating the configuration of a display device according to an embodiment.

Hereinafter, some embodiments of the present disclosure will be described in detail with reference to the accompanying drawings. In adding reference numerals to elements in each drawing, the same elements will be designated by the same reference numerals as far as possible, although they are shown in different drawings. Further, in the following description of the present disclosure, a detailed description of known functions and configurations incorporated herein will be omitted when it is determined that the description may make the subject matter of the present disclosure rather unclear.

In addition, terms, such as first, second, A, B, (a), (b) or the like may be used herein when describing components of the present disclosure. These terms are merely used to distinguish one structural element from other structural elements, and a property, an order, a sequence or the like of a corresponding structural element are not limited by the term. When it is described in the specification that one component is "connected," "coupled" or "joined" to another component, it should be read that the first component may be directly connected, coupled or joined to the second component, but also a third component may be "connected," "coupled," and "joined" between the first and second components.

FIG. 1 is a diagram illustrating the configuration of a display device according to an embodiment.

Referring to FIG. 1, a display device 100 may include a display panel 110, a data driving device 120, a gate driving device 130, a data processing device 140, and the like.

The display panel 110 may have a plurality of data lines (DL) and a plurality of gate lines (GL) arranged thereon, and a plurality of pixels may be arranged on the display panel 110. The pixel may include a plurality of sub-pixels (SP). Here, the sub-pixels may be R (red), G (green), B (blue), W (white), or the like. One pixel may include sub-pixels (SP) of RGB, sub-pixels (SP) of RGBG, sub-pixels (SP) of RGBW, or the like. In the following description, one pixel will be described as including sub-pixels of RGB for the convenience of explanation.

The data driving device 120, the gate driving device 130, and the data processing device 140 are intended to produce signals for displaying images on the display panel 110.

The gate driving device 130 may supply a gate driving signal having a turn-on voltage or a turn-off voltage to the gate line (GL). If a gate driving signal of a turn-on voltage is supplied to the sub-pixel (SP), the sub-pixel (SP) is connected to the data line (DL). In addition, if a gate driving signal of a turn-off voltage is supplied to the sub-pixel (SP), the connection between the sub-pixel (SP) and the data line (DL) is released. The gate driving device 130 may be referred to as a "gate driver".

The data driving device 120 may supply a data voltage (Vp) to the sub-pixel (SP) through the data line (DL). The data voltage (Vp) supplied to the data line (DL) may be supplied to the sub-pixel (SP) according to a gate driving signal. The data driving device 120 may be referred to a "source driver".

The data driving device 120 may include at least one integrated circuit. The at least one integrated circuit may be connected to a bonding pad of the panel 110 by means of a tape-automated-bonding (TAB) type or a chip-on-glass (COG) type, may be formed directly on the panel 110, or in some embodiments, may be integrated and formed on the panel 110. In addition, the data driving device 120 may be implemented as a chip-on-film (COF) type.

The data processing device 140 may supply control signals to the gate driving device 130 and the data driving device 120. For example, the data processing device 140 may transmit a gate control signal (GCS) trigerring a scan to the gate driving device 130. The data processing device 140 may also output image data to the data driving device 120. In addition, the data processing device 140 may transmit a data control signal for controlling the data driving device 120 so as to supply data voltages (Vp) to the respective sub-pixels (SP). The data processing device 140 may be referred to as a "timing controller".

The data processing device 140 may transmit image data and a data control signal using a main communication signal (MLP) containing a clock therein. Hereinafter, the communication signal including image data will be referred to as a "main communication signal". However, since the present embodiment is not limited to names, the above communication signal including the image data may be referred to as a "first communication signal".

The data driving device 120 may transmit the training state of a clock contained in the main communication signal (MLP) to the data processing device 140 through an auxiliary communication signal (ALP). Hereinafter, another communication signal distinguished from the main communication signal (MLP) will be referred to as an "auxiliary communication signal". However, since the present embodiment is not limited to names, the above-described another communication signal may be referred to as a "second communication signal".

The data driving device 120 and the data processing device 140 may transmit and receive at least some information using the auxiliary communication signal (ALP). For example, the data processing device 140 may transmit some of configuration information on the data driving device 120 using the auxiliary communication signal (ALP). As another example, the data driving device 120 may transmit response information to a request from the data processing device 140 using the auxiliary communication signal (ALP). As another example, the data processing device 140 may transmit equalizer (EQ) test information on an equalizer of the data driving device 120 using the auxiliary communication signal (ALP).

Some main communication signals (MLP) and some auxiliary communication signals (ALP) may be matched with each other, and may then be transmitted/received. For example, EQ test information may be transmitted/received through the auxiliary communication signal (ALP), and in response to the EQ test information, an EQ test signal may be transmitted/received using through main communication signal (MLP). The data driving device 120 may control the setting of an equalizer according to the EQ test information received through the auxiliary communication signal (ALP), and may evaluate the reception performance of the main communication signal (MLP) for each setting state of the equalizer using the EQ test signal received through the main communication signal (MLP). In addition, the data driving device 120 may determine an optimal setting of the equalizer according to the evaluation result.

Figure 2:
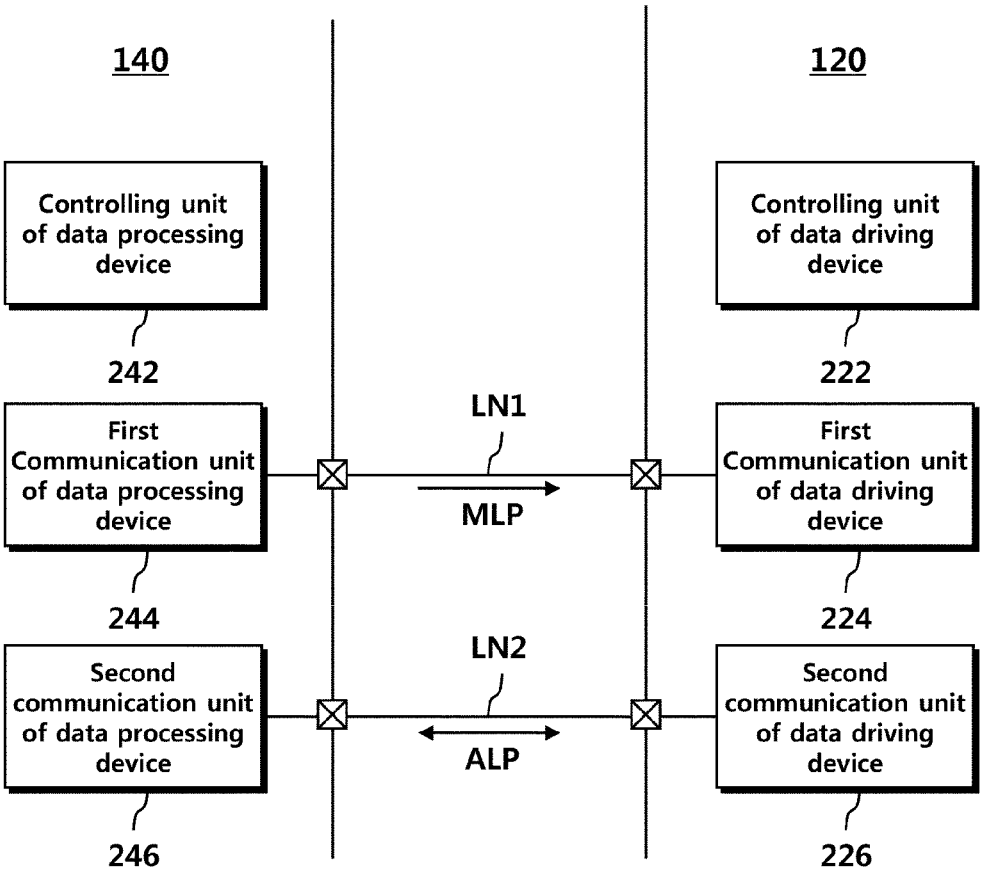
FIG. 2 is a diagram illustrating the configuration of a data processing device and a data driving device and a connection relationship therebetween according to an embodiment.

FIG. 2 is a diagram illustrating the configuration of a data processing device and a data driving device and a connection relationship therebetween according to an embodiment.

Referring to FIG. 2, the data processing device 140 may include a data processing controlling unit 242, a first communication unit 244, a second communication unit 246, and the like. In addition, the data driving device 120 may include a data driving controlling unit 222, a first communication unit 224, a second communication unit 226, and the like.

The first communication unit 244 of the data processing device and the first communication unit 224 of the data driving device may be connected to each other through a first communication line (LN1). In addition, the first communication unit 244 of the data processing device may transmit a main communication signal (MLP) to the first communication unit 224 of the data driving device through the first communication line (LN1).

The second communication unit 246 of the data processing device and the second communication unit 226 of the data driving device may be connected to each other through a second communication line (LN2). In addition, the second communication unit 246 of the data processing device and the second communication unit 226 of the data driving device may transmit and receive an auxiliary communication signal (ALP) through the second communication line (LN2).

The main communication signal (MLP) may include image data indicating a grayscale value of a pixel, and the auxiliary communication signal (ALP) may include a signal indicating the clock training state of the data driving device 120.

Figure 3:
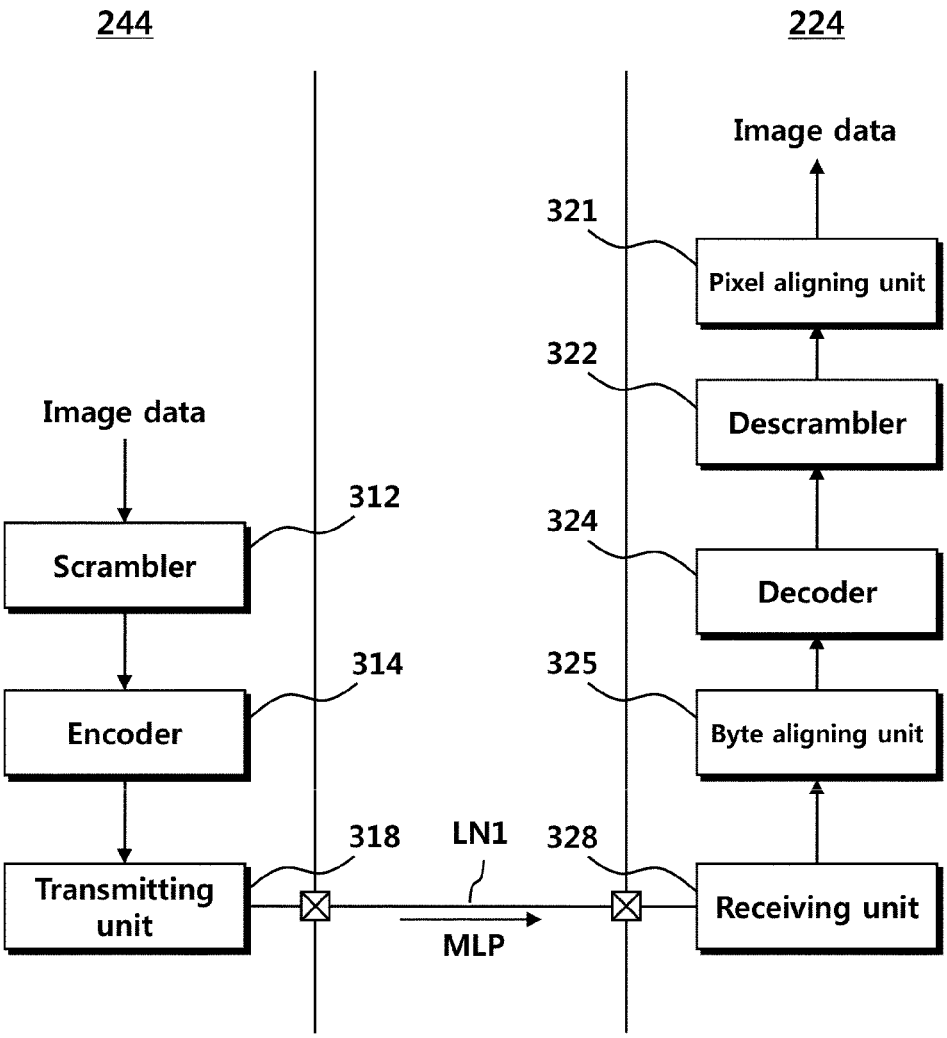
FIG. 3 is a diagram illustrating the configuration of a first communication unit of a data processing device and a first communication unit of a data driving device according to an embodiment.

FIG. 3 is a diagram illustrating the configuration of a first communication unit of a data processing device and a first communication unit of a data driving device according to an embodiment.

Referring to FIG. 3, the first communication unit 244 of the data processing device may include a scrambler 312, an encoder 314, and a transmitting unit 318, and the first communication unit 224 of the data driving device may include a receiving unit 328, a byte aligning unit 325, a decoder 324, a descrambler 322, and a pixel aligning unit 321.

Data (e.g., image data) is scrambled by the scrambler 312. Scrambling is a process of mixing respective bits of data to be transmitted, thereby preventing the same bit (e.g., 1 or 0) from being consecutively arranged K times or more (where K is a natural number of 2 or higher) in a transmission stream of data. The scrambling is executed according to a previously agreed protocol, and the descrambler 322 may perform a function of restoring a stream in which respective bits are mixed to original data.

The scrambler 312 may selectively scramble some data included in the main communication signal (MLP). For example, the scrambler 312 may scramble and transmit only zero data included the EQ test signal. More specific details thereof will be described later.

The encoder 314 may encode P bits of a transmission stream into Q bits in data P may be, for example, 8, and Q may be, for example, 10. Encoding 8 bits of data into 10 bits of data is sometimes called "8B10B encoding". 8B10B encoding is a method of encoding with DC balance codes.

The encoder 314 may encode data such that the bits of the transmission stream are increased. In addition, the encoded data may be decoded by the decoder 324 by means of a DC balance code (e.g., 8B10B). In another aspect, the encoded data may be restored to the original bits by the decoder 324.

The encoder 314 may use a limited run length code (LRLC) in the encoding of data. "Run length" means that the same bits are arranged consecutively, and LRLC controls specific bits in the middle of data such that "run length" having a predetermined size or more does not appear in the data.

In the case where the encoder 314 encodes data using an LRLC scheme, the decoder 314 may decode the data according to the LRLC scheme used by the encoder 314.

Data transmitted in parallel in the data processing device may be converted to serial data for transmission between the data processing device and the data driving device. Conversion from parallel data to serial data may be performed by a P2S converter (not shown) in the data processing device. In addition, an S2P converter (not shown) in the data driving device may perform a function of converting serially received data to parallel data.

The serially converted data may be transmitted to the data driving device through the transmitting unit 318 of the data processing device. In this case, the data may be transmitted in the form of a main communication signal (MLP) through the first communication line (LN1).

The data received by the data driving device may be transmitted to the receiving unit 328, the byte aligning unit 325, the decoder 324, the descrambler 322, and the pixel aligning unit 321.

The transmitting unit 318 may transmit data through one or more first communication lines (LN1), and the respective first communication lines (LN1) may be configured as two signal lines to transmit signals in a differential manner. In the case where a plurality of first communication lines (LN1) is used, the transmitting unit 318 may distribute data to the plurality of first communication lines (LN1), and may transmit the data. In addition, the receiving unit 328 may configure data by collecting signals received by being distributed through the plurality of first communication lines (LN1).

The data driving device may train a data link (e.g., a symbol clock or a pixel clock) according to link data included in the main communication signal (MLP). The byte aligning unit 325 and the pixel aligning unit 321 may align data in byte units (e.g., symbol units) and in pixel units according to the trained data link.

The byte aligning unit 325 may align data in byte units. The byte unit may be a basic unit constituting information included in data, and may be, for example, 8 bits, 10 bits, or the like. The byte aligning unit 325 may align data such that the data transmitted in series can be read in byte units.

The pixel aligning unit 321 may align data in pixel units. The data may sequentially include information corresponding to sub-pixels such as RGB or the like. The pixel aligning unit 321 may align data such that the data transmitted in series can be read in pixel units.

If the image data is arranged in pixel units by the pixel aligning unit 321, grayscale data (e.g., image data) may be produced for respective sub-pixels.

Figure 4:
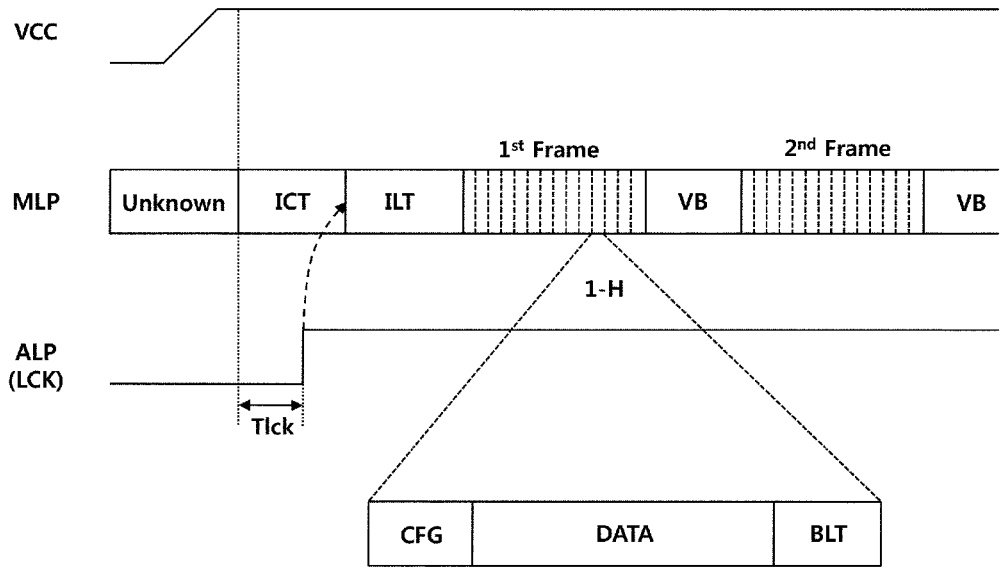
FIG. 4 is a diagram illustrating a first example of a sequence of a main communication signal and an auxiliary communication signal in a display device according to an embodiment.

FIG. 4 is a diagram illustrating a first example of a sequence of a main communication signal and an auxiliary communication signal in a display device according to an embodiment. FIG. 4 further illustrates a waveform of a driving voltage (VCC) supplied to the data processing device and the data driving device.

If the driving voltage (VCC) is supplied to the data processing device, the data processing device may transmit a clock pattern to the data driving device within a predetermined time. The clock pattern may be included in the main communication signal (MLP), and may then be transmitted.

The data driving device may receive a clock pattern, and may train a clock according to the clock pattern. In addition, the data driving device may change the voltage of an auxiliary communication signal (ALP) produced in the second communication line from a first signal level (e.g., a low voltage level) to a second signal level (e.g., a high voltage level) after the training of the clock is completed.

The data processing device and the data driving device may perform communication in a phase locked loop (PLL) method. In this method, the data driving device may produce an internal clock according to the frequency and phase of a clock pattern.

The data driving device may complete the clock training within a training time limit (Tlck). In addition, the data processing device may transmit a clock pattern during an initial clock training time period (ICT), which is longer than the training time limit (Tlck), including a constant margin time.

The clock training may be performed in an intitial step for transmitting data. In addition, if the link between the data processing device and the data driving device is broken, clock training may be performed again.

After the clock training is completed, the data processing device may transmit link data through a main communication signal (MLP).

The data driving device may receive link data according to a clock, and may train a data link according to the link data. Link training may be performed during an initial link training time period (ILT) in which the data processing device transmits link data.

Link training may be performed in an intitial step for transmitting data. If the link between the data processing device and the data driving device is broken, link training may be performed again.

After link training is completed, the data processing device may transmit image data through a main communication signal (MLP).

Image data may be transmitted frame by frame. In addition, there may be frame blank time periods {vertical blanks (VB)} between image data transmissions for respective frames. In the time period of a frame, the remaining time period except the frame blank time period may be referred to as a "frame active time period".

One frame time period may include a plurality of sub-time periods, and image data may be transmitted in one of the sub-time periods.

For example, one frame time period may include a plurality of horizontal (H) time periods (1-H) (horizontal periods) corresponding to respective ones of a plurality of lines of a display panel. The data processing device may transmit image data corresponding to each line for each H time period (1-H).

For example, in terms of the data processing device, the H time period (1-H) may include a setting transmission period, an image transmission period, and a horizontal blank period. In addition, the data processing device may transmit image data during the image transmission period of each H time period (1-H). In terms of the data driving device, the H time period (1-H) may include a setting reception period (CFG), an image reception period (DATA), and a horizontal blank period (BLT). In addition, the data driving device may receive image data for the image reception period (DATA).

The data driving device may receive image data for the image reception period (DATA), and may align the image data according to the data link. Since the image data is transmitted without a separate clock or link signal, the image data must be appropriately cut off and read by the data driving device. The data driving device may align the image data according to the above-described data link, and may cut off the image data appropriately, thereby reading the same.

The data driving device may check setting data, image data, or link data, and produce a failure signal if the setting data, image data, or link data does not meet a predefined protocol. The failure signal indicates a broken link between the data processing device and the data driving device. The data driving device may count the failure signal, and if the failure signal occurs N times or more (N is a natural number), the data driving device may transmit a signal to change the clock training state through a second communication line connected to the data processing device.

If the clock training state is changed, the data processing device may retransmit the clock pattern during the initial clock training time period (ICT) as an initial step, and may retransmit the link data during the initial link training time period (ILT). In addition, the data driving device may reperform a process of training the communication clock according to the clock pattern and training the data link according to the link data.

Figure 5:
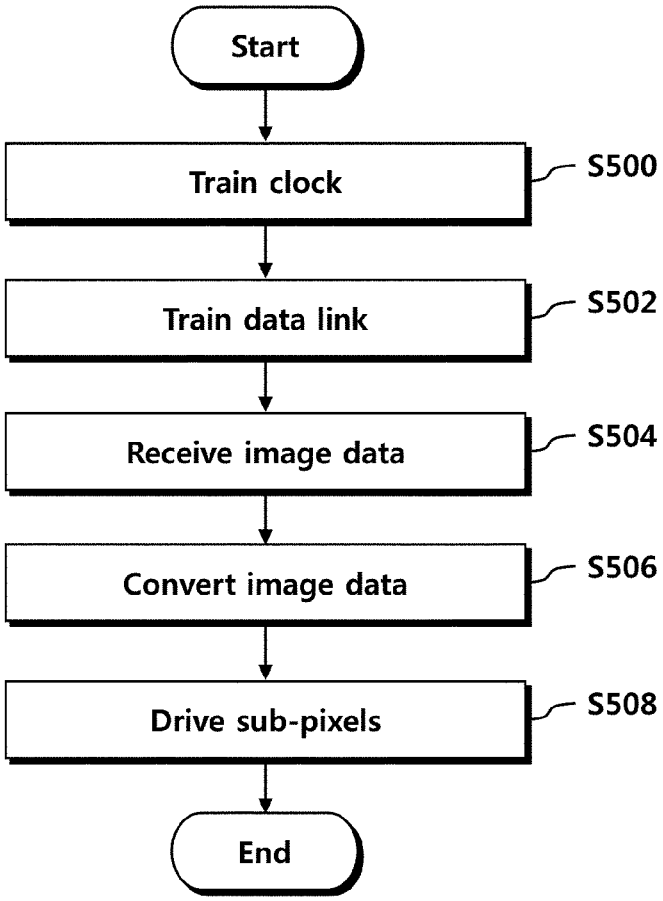
FIG. 5 is a flowchart illustrating a pixel driving method in a display device according to an embodiment.

FIG. 5 is a flowchart illustrating a pixel driving method in a display device according to an embodiment. The pixel driving method described with reference to FIG. 5 may be executed by the aforementioned data driving device.

Referring to FIG. 5, the data driving device may receive a clock pattern, and may train a clock according to the clock pattern (S500).

After the clock is trained, the data driving device may receive link data according to the clock, and may train data link according to the link data (S502). In step S502 of training the data link, the data driving device may train the data link by aligning the link data in byte units and pixel units.

After the data link is trained, the data driving device may receive image data according to the data link (S504).

Next, the data driving device may convert (e.g., decode or descramble) the image data according to information indicated by the link data (S506).

The data driving device may drive sub-pixels using the data voltages generated through the conversion of the image data (S508).

Figure 6:
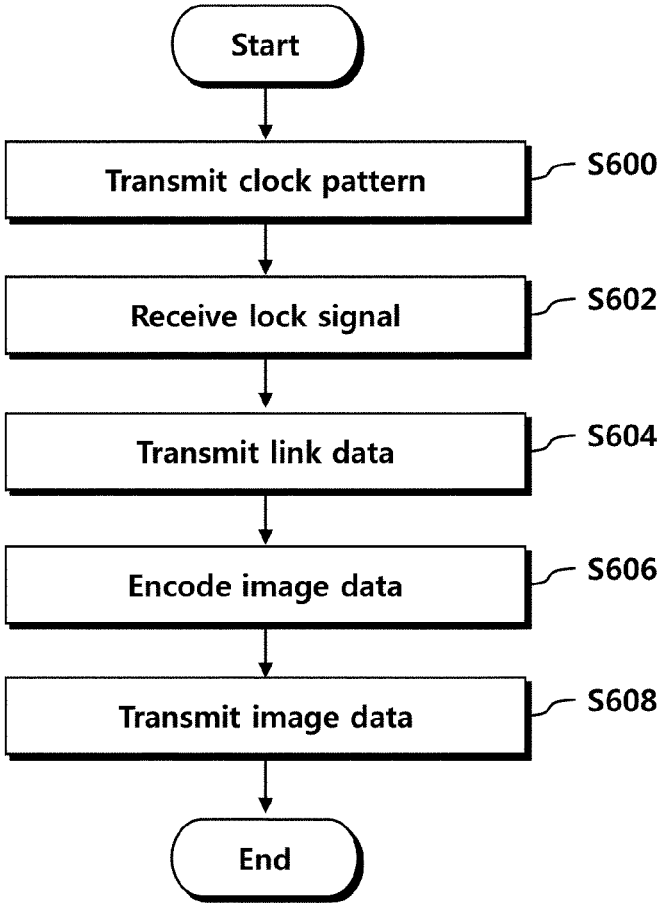
FIG. 6 is a flowchart illustrating a method of transmitting image data in a display device according to an embodiment.

FIG. 6 is a flowchart illustrating a method of transmitting image data in a display device according to an embodiment.

The image data transmission method described with reference to FIG. 6 may be executed by the above-described data processing device.

Referring to FIG. 6, the data processing device may transmit a clock pattern indicating a clock to the data driving device (S600). The data driving device may train a clock according to the clock pattern. When the training of the clock is completed, the data driving device may transmit a lock signal to the data processing device. Here, the lock signal is a signal indicating the completed state of the clock training, among signals indicating the clock training states.

After receiving the lock signal (S602), the data processing device may transmit link data to the data driving device (S604). The data processing device may transmit link data in synchronization with a clock.

The data processing device may encode the image data (S606), and may transmit the encoded image data to the data driving device (S608).

The step of encoding the image data (S606) may include a step of scrambling the image data, a step of encoding the image data in the LRLC, or the like.

Figure 7:
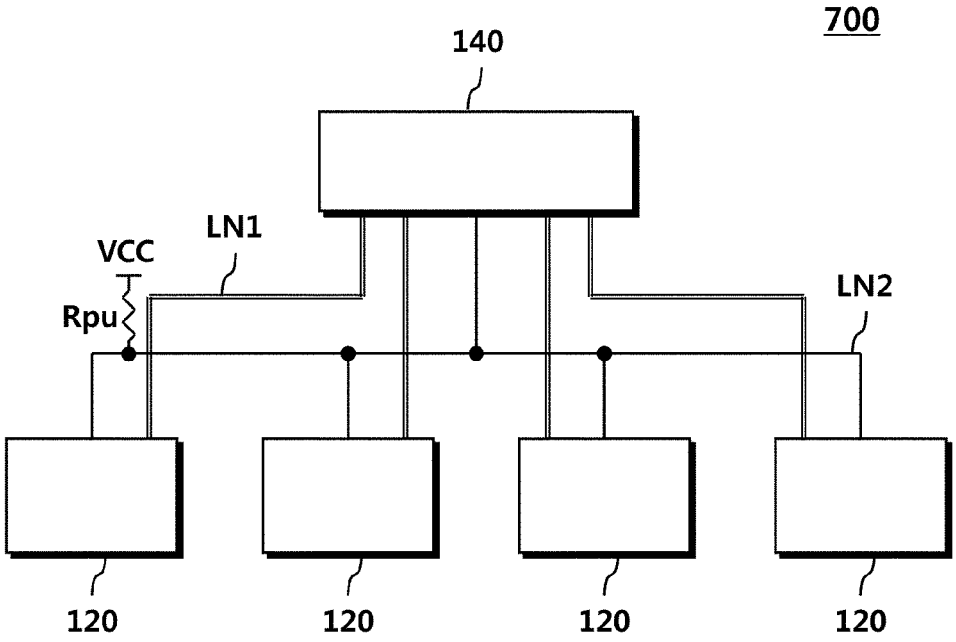
FIG. 7 is a diagram illustrating the configuration of a display driving system according to an embodiment.

FIG. 7 is a diagram illustrating the configuration of a display driving system according to an embodiment.

Referring to FIG. 7, a driving system 700 may include a data processing device 140 and a plurality of data driving devices 120.

The data processing device 140 and the plurality of data driving devices 120 may be connected one to one through a plurality of first communication lines (LN1). In addition, the data processing device 140 and the plurality of data driving devices 120 may be connected through a second communication line (LN2) configured as a common bus.

The first communication line (LN1) may be a differential signal line including two signal lines, and the second communication line (LN2) may be a single signal line driven as an open drain. A pull-up resistor (Rpu) may be connected to the second communication line (LN2). One end of the pull-up resistor (Rpu) may be connected to the second communication line (LN2), and a driving voltage (VCC) may be supplied to the opposite end thereof.

The first communication line (LN1) may be a differential signal line driven by current, and the second communication line (LN2) may be a single signal line driven as an open drain. According to this configuration, the data rate of a main communication signal transmitted through the first communication line (LN1) may be higher than the data rate of an auxiliary communication signal transmitted and received through the second communication line (LN2).

A plurality of data driving devices 120 may be connected to the second communication line (LN2), and multi-drop may be implemented through such a connection.

The data processing device 140 may transmit image data containing a clock to the data driving device 120 through the first communication line (LN1). In addition, the data processing device 140 may transmit a communication signal containing a clock to the data driving device 120 through the second communication line (LN2). The clock transmitted through the first communication line (LN1) and the clock transmitted through the second communication line (LN2) may have different frequencies or different voltage levels, and in order to distinguish between the same, hereinafter, the clock transmitted through the first communication line (LN1) will be referred to as a "first clock", and the clock transmitted through the second communication line (LN2) is referred to as a "second clock".

The data processing device 140 may transmit a main communication signal containing a first clock through the first communication line (LN1), and the data driving device 120 may transmit the training state of the first clock through the second communication line (LN2). The signal in the state in which the training of the first clock is completed may be called a "lock signal". The data driving device 120 may transmit the lock signal to the data processing device 140 through the second communication line (LN2).

The data processing device 140 and the data driving device 120 may transmit and receive at least some information through the second communication line (LN2). The information transmitted through the second communication line (LN2) may be some of the setting information, which can be transmitted for the setting reception period (see CFG in FIG. 4) through the first communication line (LN1), or may be information other than the setting information.

The data processing device 140 may transmit information to the data driving device 120 through the second communication line (LN2), and the data driving device 120 may also transmit information to the data processing device 140 through the second communication line (LN2).

The first communication unit (see 244 in FIG. 2) of the data processing device 140 may be connected to the first communication unit (see 224 in FIG. 2) of the data driving device 120 through the first communication line (LN1), and the second communication unit (see 246 in FIG. 2) of the data processing device 140 may be connected to the second communication unit (see 226 in FIG. 2) of the data driving device 120 through the second communication line (LN2). Since the first communication unit (see 244 in FIG. 2) of the data processing device 140 and the first communication unit (see 224 in FIG. 2) of the data driving device 120 have been described with reference to FIG. 3, hereinafter, the second communication unit (see 246 in FIG. 2) of the data processing device 140 and the second communication unit (see 226 in FIG. 2) of the data driving device 120 will be described.

Figure 8:
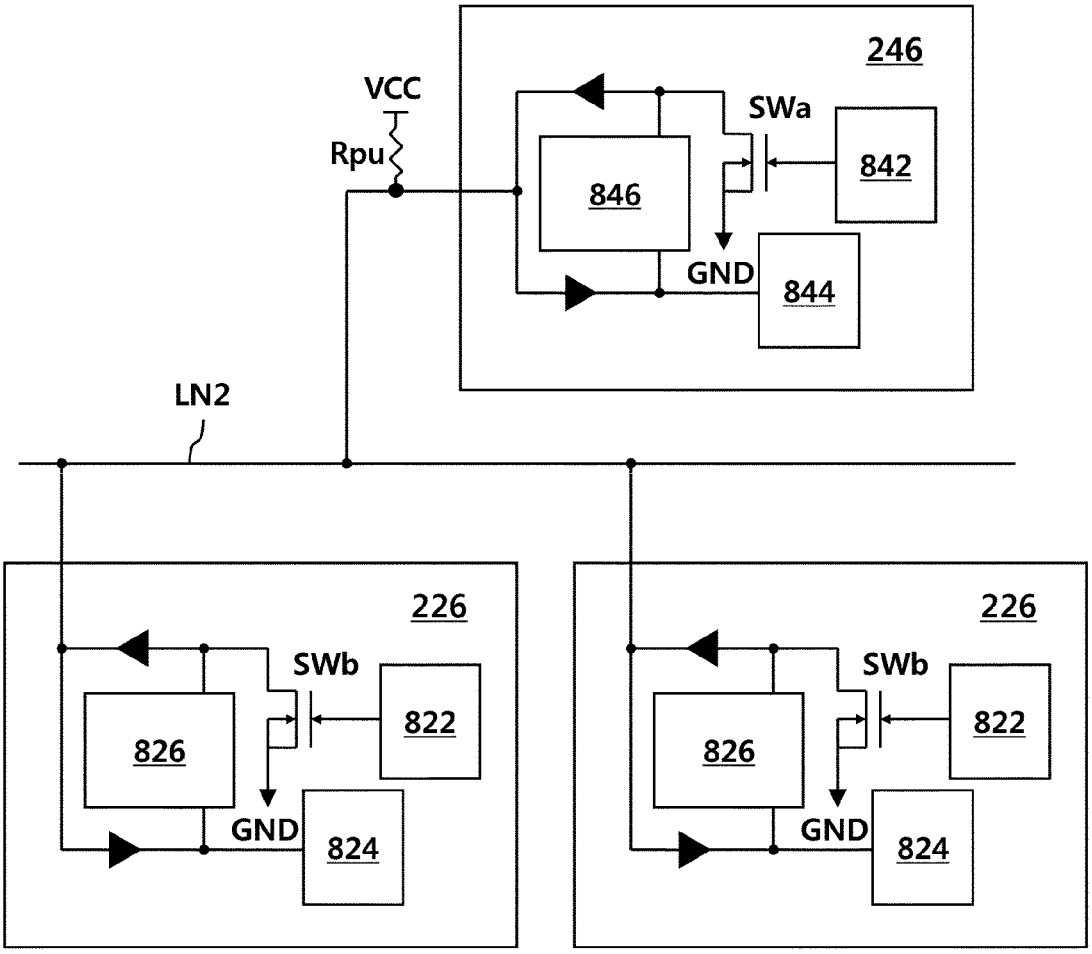
FIG. 8 is a diagram illustrating the configuration of a second communication unit of a data processing device and a second communication unit of a data driving device according to an embodiment.

FIG. 8 is a diagram illustrating the configuration of a second communication unit of a data processing device and a second communication unit of a data driving device according to an embodiment.

Referring to FIG. 8, a second communication unit 246 of a data processing device may include a transmission module 842, a reception module 844, a monitoring module 846, a switch (SWa), and the like. In addition, a second communication unit 226 of a data driving device may include a transmission module 822, a reception module 824, a monitoring module 826, a switch (SWb), and the like. In order to avoid confusion in the description, the elements of the second communication unit 246 of the data processing device will be referred to as a P-transmission module 842, P-reception module 844, a P-monitoring module 846, and a P-switch (SWa), respectively. In addition, the elements of the second communication unit 226 of the data driving device will referred to as a D-transmission module 822, a D-reception module 824, a D-monitoring module 826, and a D-switch (SWb), respectively.

The P-transmission module 842 and the D-transmission module 822 may transmit signals through a second communication line (LN2). A pull-up resistor (Rpu) may be connected to the second communication line (LN2), and the P-transmission module 842 and the D-transmission module 822 may change the voltage of the second communication line (LN2) from a first signal level {e.g., the ground voltage (GND)} to a second signal level {e.g., a driving voltage (VCC)} through on/off control with respect to the P-switch (SWa) and the D-switch (SWb). One ends of the P-switch (SWa) and the D-switch (SWb) may be connected to the second communication line (LN2), and the opposite ends thereof may be connected to a low voltage source (e.g., the ground). The P-transmission module 842 and D-The transmission module 822 may control the signal voltage of the second communication line (LN2) through on/off control with respect to the P-switch (SWa) and the D-switch (SWb). For example, if the P-switch (SWa) or the D-switch (SWb) is turned on, the voltage of the second communication line (LN2) may become a low voltage {e.g., the ground voltage (GND)}, and if the P-switch (SWa) and the D-switch (SWb) are turned off, the voltage of the second communication line (LN2) may become a high voltage {e.g., a driving voltage (VCC)}.

The P-transmission module 842 may transmit information to the data driving device through control with respect to the P-switch (SWa). In addition, the D-transmission module 822 may transmit a signal indicating the clock training state (e.g., a lock signal) or other information to the data processing device through control with respect to the D-switch (SWb).

The P-reception module 844 and D-reception module 824 may receive signals from the second communication line (LN2).

Meanwhile, in the case where two devices simultaneously control the second communication line (LN2), a fault may occur in the second communication line (LN2).

For example, the D-transmission module 822 may change the voltage of the second communication line (LN2) when the clock training is required to be re-executed, such as a situation in which the data driving device operates abnormally. For example, the D-transmission module 822 may change the voltage of the second communication line (LN2) to a first signal level (e.g., the ground voltage) when the link of the main communication signal is broken. In the case where the D-transmission module 822 changes the voltage of the second communication line (LN2) in the process in which the P-transmission module 842 or the D-transmission module 822 of another data driving device transmits information through the second communication line (LN2), the fault described above may occur.

The P-monitoring module 846 and the D-monitoring module 826 may detect this fault.

The P-monitoring module 846 may compare a TX signal transmitted from the P-transmission module 842 with an RX signal received by the P-reception module 844, and may produce an error if the TX signal is different from the RX signal. In addition, if the P-monitoring module 846 produces an error, the P-transmission module 842 may switch the voltage of the second communication line (LN2) to a first signal level (e.g., the ground voltage).

The D-monitoring module 826 may compare a TX signal transmitted from the D-transmission module 822 with an RX signal received by the D-reception module 824, and may produce an error if the TX signal is different from the RX signal. In addition, if the D-monitoring module 826 produces an error, the D-reception module 824 may switch the voltage of the second communication line (LN2) to a first signal level (e.g., the ground voltage).

The second communication unit (e.g., the monitoring module 846 or 826) produces an error, the first communication unit may perform a clock recovery sequence for retraining the first clock. Here, the clock recovery sequence may include operations of the data processing device and the data driving device in the initial clock training time period (see ICT in FIG. 4) described with reference to FIG. 4.

Meanwhile, a predetermined protocol may be applied to the auxiliary communication signal transmitted and received through the second communication line (LN2). In particular, when information is transmitted and received through the second communication line (LN2), a predetermined protocol may be applied to the auxiliary communication signal.

Figure 9:
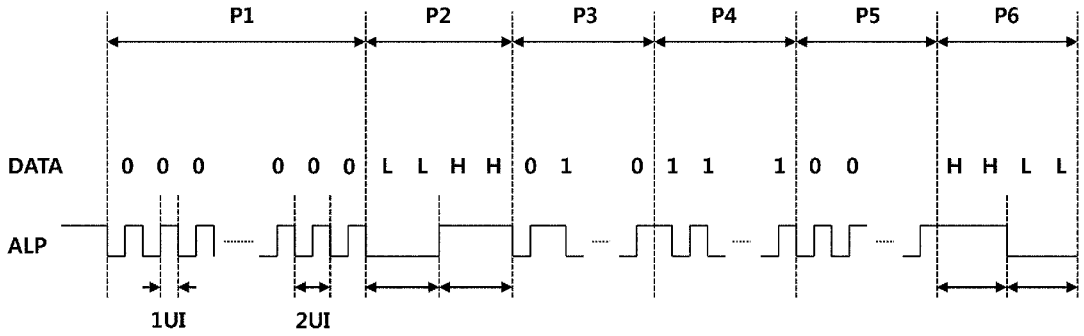
FIG. 9 is a diagram illustrating the configuration of an information transmission/reception protocol of an auxiliary communication signal in a display device according to an embodiment.

FIG. 9 is a diagram illustrating the configuration of an information transmission/reception protocol of an auxiliary communication signal in a display device according to an embodiment.

Referring to FIG. 9, one message in the auxiliary communication signal may include six parts (P1) to (P6).

A clock may be transmitted through a first part (P1). In the auxiliary communication signal, data bits may be encoded using Manchester-II code. In this case, one bit may include two unit pulses (UI). In Manchester-II coding, in the case where all data bits transmitted in the first part (P1) represent "0" or "1", a pulse synchronized with a clock may be transmitted.

A receiving entity may perform training according to the clock received in the first part (P1). In order to distinguish the clock transmitted through the main communication line, the clock transmitted and received in the first part (P1) may be referred to as a "second clock".

After the second clock is transmitted, a start signal indicating the start of the message may be transmitted in a second part (P2), and an end signal indicating the end of the message may be transmitted in a sixth part (P6), which is the last part of the message.

A message header is transmitted in a third part (P3). The message header may include parameter values such as a data type, a mode, an identification number (ID) of a receiving entity, a data length, and a setting register address of a receiving entity.

A fourth part (P4) may include information transmitted and received through the message.

In addition, a fifth part (P5) may include a checksum. Data bytes from the third part (P3) to the fourth part (P4) may be calculated by an adder, and the checksum may include M bits (M is a natural number) as least significant bits of the above calculation result value.

Meanwhile, the auxiliary communication signal may be divided into a plurality of modes, and the data processing device and the data driving device may perform different operations from each other in the respective modes.

Figure 10:
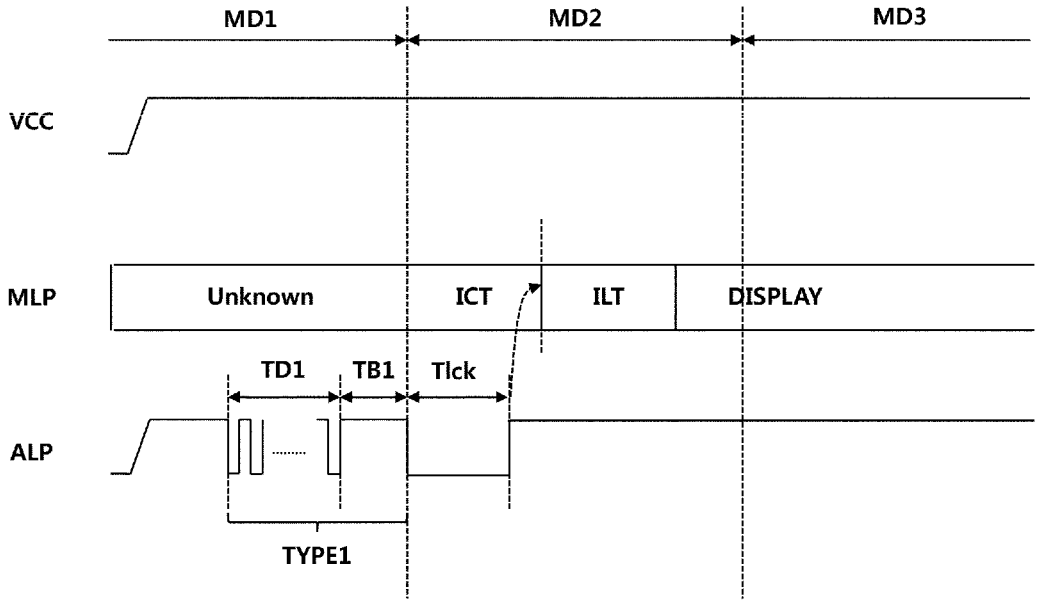
FIG. 10 is a diagram illustrating a second example of a sequence of a main communication signal and an auxiliary communication signal in a display device according to an embodiment.

FIG. 10 is a diagram illustrating a second example of a sequence of a main communication signal and an auxiliary communication signal in a display device according to an embodiment.

Referring to FIG. 10, the auxiliary communication signal (ALP) may be divided into three modes (MD1), (MD2), and (MD3). At the initial time after starting, an auxiliary communication signal (ALP) corresponding to a first mode (MD1) may be transmitted and received, when the first mode (MD1) ends, an auxiliary communication signal (ALP) corresponding to a second mode (MD2) may be transmitted and received, and when the second mode (MD2) ends, an auxiliary communication signal (ALP) corresponding to a third mode (MD3) may be transmitted and received.

According to the signal classification, the auxiliary communication signal (ALP) may be classified into a lock mode and a communication mode. The first mode (MD1) may correspond to a communication mode, the second mode (MD2) may correspond to a lock mode, and the third mode (MD3) may correspond to a combination of the lock mode and the communication mode. In the lock mode, the data driving device may transmit, to the data processing device, a lock signal or a lock failure signal indicating that clock training has failed using the auxiliary communication signal (ALP). In addition, in the communication mode, the data driving device or the data processing device may transmit information or request information using the auxiliary communication signal (ALP).

When the driving voltage (VCC) is supplied, the data processing device and the data driving device may operate in the first mode (MD1). In the first mode (MD1), the main communication signal (MLP) may not be used, and may remain in an unknown state. In addition, in the first mode (MD1), the data processing device may transmit at least some setting information to the data driving device through the second communication line. This type of message for transmitting the setting information may be defined as a first type of message (TYPE1). The data driving device may receive a training signal for a first clock through the main communication signal (MLP) after receiving the first type of message (TYPE1).

The first type of message (TYPE1) may include a first data period (TD1) for transmitting data and a first blank period (TB1) for maintaining a time interval. In the first data period (TD1), the data processing device may transmit a message in the protocol described with reference to FIG. 9. In addition, in the first blank period (TB1), the data processing device may change the voltage of the second communication line to a second signal level {e.g., a driving voltage (VCC)}.

The data processing device may set various parameters of the data driving device through the first type of message (TYPE1). In terms of sequence, the setting of parameters is performed before the main communication signal (MLP) is transmitted and received, so that the data processing device is able to preliminarily configure parameters necessary for the transmission and reception of the main communication signal (MLP) through the auxiliary communication signal (ALP).

In the first mode (MD1), the data processing device and the data driving device may transmit and receive EQ test information through the auxiliary communication signal (ALP). The EQ test information may include setting information on the equalizer included in the data driving device. Here, the setting information on the equalizer may include, for example, a set value for the gain of the equalizer, and may include information about whether or not to evaluate the reception performance while changing the setting of the equalizer. Here, the EQ test information may be transmitted and received using the first type of message (TYPE1).

When the first blank period (TB1) ends, the data driving device may change the second communication line to a first signal level (e.g., the ground voltage) to indicate that the data driving device is ready for clock training, and the data processing device may transmit a clock training signal (e.g., a clock pattern) using a first communication line. The mode at this time may be referred to as a "second mode" (MD2).

In the second mode (MD2), the data driving device may receive a training signal (e.g., a clock pattern) for the first clock, and when the clock training is completed, may change the voltage of the second communication line to a second signal level {e.g., a driving voltage (VCC)} to transmit a signal on the clock training state through an auxiliary communication signal (ALP).

The data driving device may perform clock training within a predetermined clock training time limit (Tlck). The data processing device may maintain the initial clock training time period (ICT) to be longer than the clock training time limit (Tlck.

Link training is performed after the clock training. After the initial link training time period (ILT) ends and a predetermined margin time passes, the second mode (MD2) may be switched to the third mode (MD3).

Figure 11:
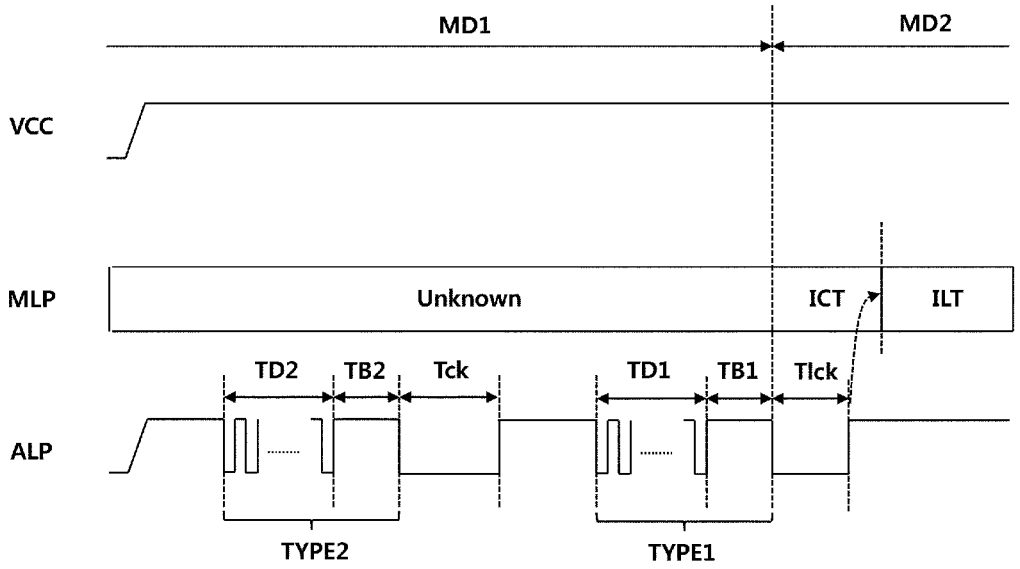
FIG. 11 is a diagram illustrating a third example of a sequence of a main communication signal and an auxiliary communication signal in a display device according to an embodiment.

FIG. 11 is a diagram illustrating a third example of a sequence of a main communication signal and an auxiliary communication signal in a display device according to an embodiment.

Referring to FIG. 11, the data processing device may transmit a state check command for checking the state of the data driving device through a second type of message (TYPE2) in the first mode (MD1) corresponding to an initial time after starting.

The second type of message (TYPE2) may include a second data period (TD2) for transmitting data and a second blank period (TB2) for maintaining a time interval. In the second data period (TD2), the data processing device may transmit a message in the protocol described with reference to FIG. 9. Here, the second data period (TD2) may include a command for checking the state of the receiving entity. In the second blank period (TB2), the data processing device may change the voltage of the second communication line to a second signal level {e.g., a driving voltage (VCC)}.

The data driving device may respond to a state check command. If the data driving device is in a normal operation, the data driving device may maintain the voltage of the second communication line at a first signal level (e.g., the ground voltage) for a predetermined period of time. In this case, if the voltage of the second communication line remains at the first signal level for a half of a predetermined check time (Tck) or more, the data processing device may determine that the data driving device is in a normal operation. If the data driving device is determined to be in an abnormal operation, the data processing device may retransmit the second type of message (TYPE2).

In terms of sequence, the second type of message (TYPE2) may be transmitted first, followed by the first type of message (TYPE1).

Figure 12:
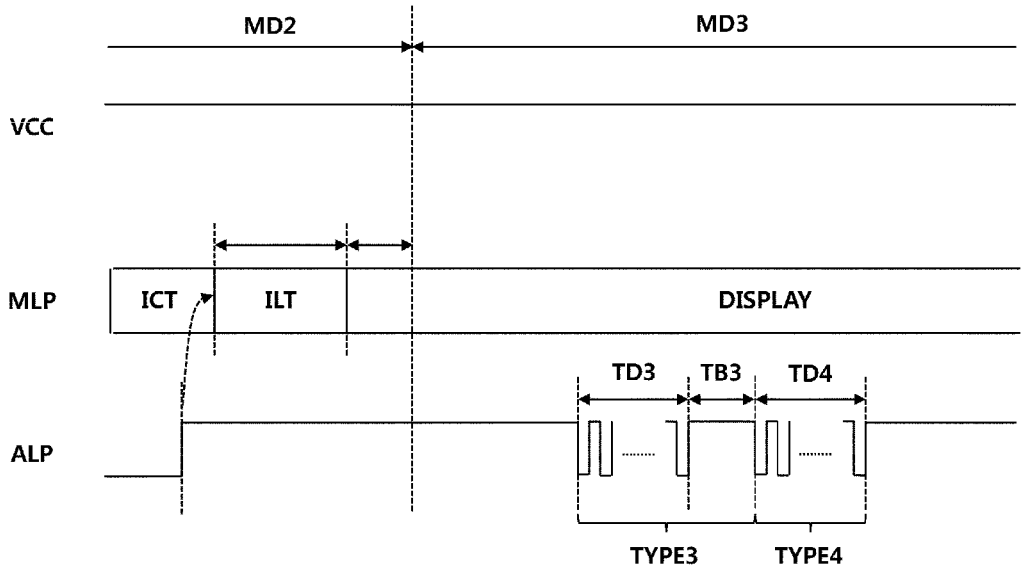
FIG. 12 is a diagram illustrating a fourth example of a sequence of a main communication signal and an auxiliary communication signal in a display device according to an embodiment.

FIG. 12 is a diagram illustrating a fourth example of a sequence of a main communication signal and an auxiliary communication signal in a display device according to an embodiment.

Referring to FIG. 12, in a third mode (MD3) in which image data is transmitted and received through a main communication signal (MLP), the data processing device or the data driving device may transmit a request command using a third type of message (TYPE3), and the data driving device or the data processing device may transmit reply data in response to the request command using a fourth type of message (TYPE4).

The third type of message (TYPE3) may include a third data period (TD3) for transmitting data and a third blank period (TB3) for maintaining a time interval. In the third data period (TD3), the data processing device or the data driving device may transmit a message in the protocol described with reference to FIG. 9. Here, the third data period (TD3) may include a command for requesting information about a receiving entity. In the third blank period (TB3), the data processing device or the data driving device may change the voltage of the second communication line to a second signal level {e.g., a driving voltage (VCC)}.

The data driving device or the data processing device may transmit reply data through the fourth type of message (TYPE4) in response to the request command. The reply data may be included in the fourth data period (TD4) for transmitting data in the fourth type of message (TYPE4).

In the second communication unit of the data driving device, a communication mode may be classified into a reception mode and a transmission mode. The second communication unit of the data driving device may switch from the reception mode to the transmission mode or the lock mode after the voltage of the second signal level is maintained in the second communication line during a predetermined period of time (e.g., the first blank period, the second blank period, or the third blank period).

The message transmitted and received through the auxiliary communication signal (ALP), such as the first type of message, the second type of message, the third type of message, or the fourth type of message, may include an identification number of a receiving entity or an identification number of the data driving device. If the identification number included in the message is different from that of the receiving entity or the data driving device, the receiving entity or the data driving device may stop monitoring faults by the monitoring module of the second communication unit for a predetermined period of time, and may stop control with respect to the second communication line by the transmission module of the second communication unit.

Figure 13:
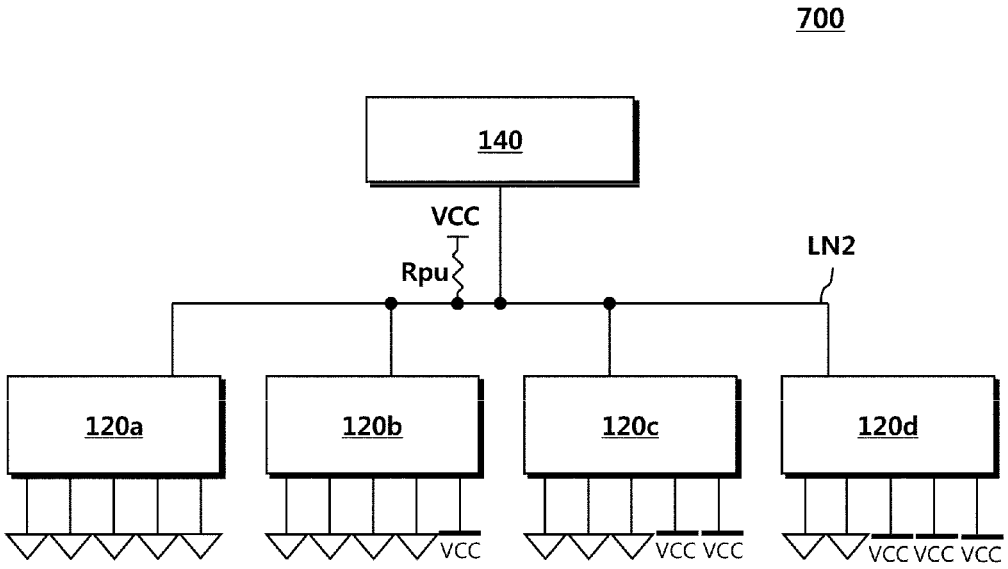
FIG. 13 is a diagram illustrating configuring of an identification number in a data driving device according to an embodiment.

FIG. 13 is a diagram illustrating configuring of an identification number in a data driving device according to an embodiment.

Referring to FIG. 13, respective data driving devices 120*a*, 120*b*, 120*c*, and 120*d* may have identification numbers configured thereto.

The identification number may be configured by a plurality of pins exposed to the outside of the respective data driving devices 120*a*, 120*b*, 120*c*, and 120*d*. For example, if a low voltage (e.g., the ground voltage) is applied to all setting pins, the identification number may be set to "0", and if a high voltage {e.g., a driving voltage (VCC)} is applied to only one setting pin, the identification number may be set to "1".

The messages of an auxiliary communication signal, including a state check command, a request command, etc., such as the first type of message, the second type of message, the third type of message, or the fourth type of message, may include the identification number of the data driving device.

In addition, the data driving device may process only the auxiliary communication signal corresponding to the identification number, among the auxiliary communication signals received from the data processing device.

Meanwhile, the data driving device may include an equalizer. The equalizer may enhance the signal reception performance by adjusting a received signal. The equalizer may adjust the signal in any of various methods. For example, the equalizer may adjust the magnitude of the signal. The equalizer may adjust the magnitude of the signal by multiplying the signal by a constant gain. In this case, if the gain is excessively small, the magnitude of the signal becomes small, thereby degrading the reception performance of the signal. In addition, if the gain is excessively large, a noise component included in the signal may be amplified, thereby lowering the reception performance of the signal. According to a conventional method, a set value of the equalizer (e.g., a set value of the gain) is determined manually by an engineer or unilaterally determined by a transmitting device that transmits a specific set value. However, such a conventional method has a problem in which excessive effort is required to configure the equalizer or in which the accuracy of setting of the equalizer deteriorates. Hereinafter, an embodiment in which EQ test information and an EQ test signal are transmitted and received through a first communication line and a second communication line provided in the data processing device and the data driving device to automatically configure an equalizer will be described.

Figure 14:
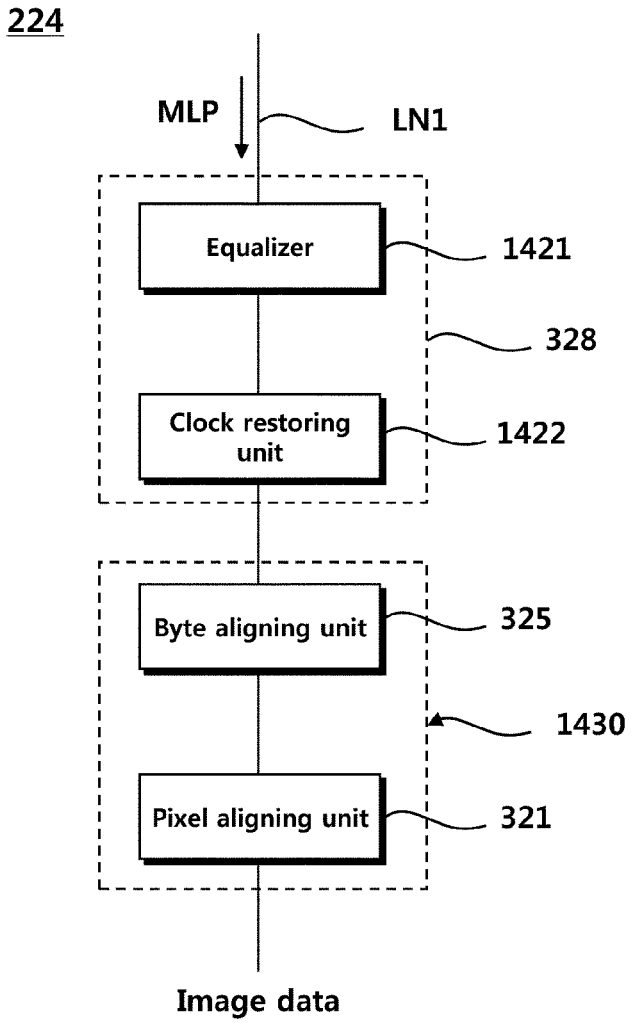
FIG. 14 is a diagram illustrating an example of the configuration of a first communication unit of a data driving device in which an equalizer is further included according to an embodiment.

FIG. 14 is a diagram illustrating an example of the configuration of a first communication unit of a data driving device in which an equalizer is further included according to an embodiment.

Referring to FIG. 14, the first communication unit 224 of the data driving device may include an equalizer 1421 and a clock restoring unit 1422 in the receiving unit 328.

The equalizer 1421 may be connected to a first communication line (LN1), and may adjust a main communication signal (MLP) received through the first communication line (LN1). In addition, the equalizer 1421 may transmit the adjusted main communication signal (MLP) to the clock restoring unit 1422, the byte aligning unit 325, and/or the pixel aligning unit 321, and the like, thereby improving the reception performance of the first communication unit 224 of the data driving device.

The equalizer 1421 may adjust the main communication signal (MLP) according to setting. For example, the equalizer 1421 may have a gain stored as a set value, and may adjust an amplification gain of the main communication signal (MLP) according to the configured gain.

The clock restoring unit 1422 may receive a clock pattern through a main communication signal (MLP), and may train a first clock according to the clock pattern. In this case, the clock training performance of the clock restoring unit 1422 may be affected by the adjustment of the main communication signal (MLP) by the equalizer 1421.

A link recovery part 1430 including the byte aligning unit 325 and the pixel aligning unit 321 may train a link clock (e.g., a symbol clock or a pixel clock) according to link data, and may align image data in byte units (e.g., in symbol units) or in pixel units according to the link clock. In this case, the link training performance of the link recovery part 1430 or the link recovery performance of the link recovery part 1430 may be affected by the adjustment of the main communication signal (MLP) by the equalizer 1421.

Meanwhile, in order to automatically determine an optimal setting of the equalizer, the data processing device may transmit a plurality of EQ test signals to the data driving device, and the data driving device may evaluate the reception performance of a plurality of EQ test signals (e.g., the clock training performance of the clock recovery unit 1422 or the link recovery performance of the link recovery part 1430) in different setting states of the equalizer, and may discover an optimal set value. The data processing device may transmit EQ test information before transmitting the EQ test signal so that the data driving device may evaluate the EQ test signal while changing the setting of the equalizer. The EQ test information may include information about the setting of the equalizer. For example, the EQ test information may include a set value for the gain of the equalizer. The data processing device may transmit EQ test information so that the data driving device may configure the equalizer as a specific set value, and may then transmit an EQ test signal so that the data driving device may evaluate the EQ test signal using a specific set value. The data processing device may transmit EQ test information through an auxiliary communication signal, and may transmit the EQ test signal through the main communication signal (MLP) so that the test on the equalizer may be expedited.

Figure 15:
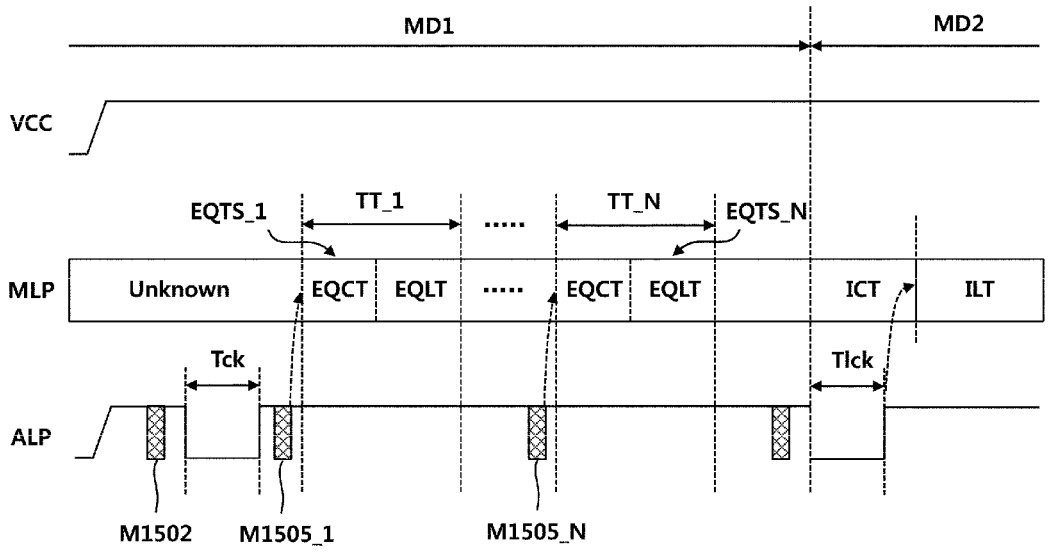
FIG. 15 is a diagram illustrating a fifth example of a sequence of a main communication signal and an auxiliary communication signal in a display device according to an embodiment.

FIG. 15 is a diagram illustrating a fifth example of a sequence of a main communication signal and an auxiliary communication signal in a display device according to an embodiment.

Referring to FIG. 15, the data processing device may transmit a plurality of pieces of the EQ test information (M1505_1) to (M1505_N) through an auxiliary communication signal (ALP) in the time period of the first mode (MD1) corresponding to the time period prior to the initial clock training time period (ICT).

The respective pieces of the EQ test information (M1505_1) to (M1505_N) may include different set values for the equalizer. For example, first EQ test information (M1505_1) may include a first set value for the equalizer gain, and $N^{th}$ EQ test information (M1505_N) may include an $N^{th}$ set value for the equalizer gain. Here, $N^{th}$ (N is a natural number) indicates a step for testing a set value of the equalizer. For example, if N is 8, the equalizer gain may be tested using a value in the 8th step.

The data processing device may transmit EQ test signals (EQTS_1) to (EQTS_N) through a main communication signal (MLP) subsequent to the respective pieces of the EQ test information (M1505_1) to (M1505_N) or a predetermined period of time after transmitting the respective pieces of the EQ test information (M1505_1) to (M1505_N).

The data driving device (e.g., a controlling unit) may receive the respective pieces of the EQ test information (M1505_1) to (M1505_N) to control the setting of the equalizer, and may evaluate the reception performance of the data driving device (e.g., the first communication unit) using the EQ test signals (EQTS_1) to (EQTS_N) received through the main communication signal (MLP) for each setting state of the equalizer. In addition, the data driving device (e.g., a controlling unit) may determine an optimal setting of the equalizer according to the evaluation result.

The EQ test signals (EQTS_1) to (EQTS_N) may include a clock pattern. For example, some of the EQ test signals (EQTS_1) to (EQTS_N) may include an EQ clock pattern (EQCT).

The data driving device (e.g., the first communication unit) may restore a first clock from the EQ clock pattern, and the data driving device (e.g., a controlling unit) may evaluate the reception performance of the data driving device (e.g., the first communication unit) using the recovery result of the first clock.

The EQ test signals (EQTS_1) to (EQTS_N) may include link data. For example, some of the EQ test signals (EQTS_1) to (EQTS_N) may include EQ link data (EQLT).

The data driving device (e.g., the first communication unit) may receive EQ link data (EQLT) according to the restored first clock, and the data driving device (e.g., a controlling unit) may evaluate the reception performance of the data driving device (e.g., the first communication unit) by a reception rate of a plurality of symbols included in the EQ link data (EQLT).

The EQ link data (EQLT) may include a plurality of zero symbols that are direct current (DC)-balanced. "DC-balanced" may mean that, for example, the number of bits indicating "1" is the same as the number of bits indicating "0". In addition, the zero symbol may be a symbol indicating "0" as a byte value.

The data driving device (e.g., a controlling unit) may evaluate the reception performance of the data driving device (e.g., the first communication unit) by a reception rate of a plurality of zero symbols. The plurality of zero symbols may be scrambled. "Being scrambled" may mean that the positions of the bits constituting a symbol are mixed. The data driving device (e.g., a controlling unit) may test different types of symbols using the plurality of scrambled zero symbols.

The link data (EQLT) may include a plurality of first type symbols and a plurality of second type symbols. The plurality of first type symbols may be intended for link training, and the plurality of second type symbols may be intended for evaluation of the reception performance. For example, the plurality of first type symbols may include four different symbols representing R (red), G (green), B (blue), and W (white), and the four symbols may be repeatedly arranged in one period of the link data (EQLT). The plurality of second type symbols may include zero symbols.

The data driving device (e.g., the first communication unit) may restore a link clock (e.g., a symbol clock and/or a pixel clock) using a plurality of first type symbols, and may receive a plurality of second type symbols according to the link clock. In addition, the data driving device (e.g., a controlling unit) may evaluate the reception performance of the data driving device (e.g., the first communication unit) using information about whether or not the link clock is restored and/or reception rates of the plurality of second type symbols.

The data driving device (e.g., a controlling unit) may configure the equalizer as a set value of the equalizer with the best reception performance. Alternatively, the data driving device (e.g., a controlling unit) may configure the equalizer at an intermediate value of a plurality of setting states evaluated as higher reception performance.

The data driving device (e.g., a controlling unit) may determine an optimal set value for the equalizer, and may transmit the determined set value to the data processing device using an auxiliary communication signal (ALP). In addition, the data processing device (e.g., a controlling unit) may determine whether or not the received set value is similar to a pre-stored value, and if there is a big difference therebetween, may produce a signal of an error or a warning.

The data driving device (e.g., the second communication unit) may receive a plurality of pieces of the EQ test information (M1505_1) to (M1505_N) indicating different set values in different time periods. In addition, the data driving device (e.g., the first communication unit) may receive respective EQ test signals (EQTS_1) to (EQTS_N) during the time period subsequent to the time period during which the respective pieces of the EQ test information (M1505_1) to (M1505_N) are received.

The data driving device (e.g., the first communication unit) may receive the EQ test signals (EQTS_1) to (EQTS_N) within a time period before receiving the image data after starting, and the data driving device (e.g., a controlling unit) may determine an optimal setting for the equalizer before the image data is received.

The data processing device may check the state of the data driving device before the EQ test. For example, the data driving device (e.g., the second communication unit) may receive a state check command (M1502) through an auxiliary communication signal (ALP) before receiving the EQ test information (M1505_1) to (M1505_N), and may change the voltage level of the second communication line to a specific voltage level (e.g., the ground level) for a predetermined time (Tck) in response to the state check command (M1502).

The data processing device may transmit the EQ test signals (EQTS_1) to (EQTS_N) at a predetermined time interval during N time periods (TT_1) to (TT_N), respectively. For example, the data processing device may transmit the EQ test signals (EQTS_1) to (EQTS_N) during respective ones of the N frame time periods. Alternatively, the data processing device may transmit the EQ test signals (EQTS_1) to (EQTS_N) during respective ones of sub-time periods obtained by dividing the frame active time period of one frame by N.

The data processing device (e.g., a controlling unit of the data processing device) may repeat periodic operations in frame units. In order to equally apply the effect of noise from the periodic operations to the respective EQ test signals (EQTS_1) to (EQTS_N), the data processing device may transmit the EQ test signals (EQTS_1) to (EQTS_N) during the respective ones of the N frame time periods, or may transmit the EQ test signals (EQTS_1) to (EQTS_N) during the respective ones of the sub-time periods obtained by dividing the frame active time period of one frame by N.

Figure 16:
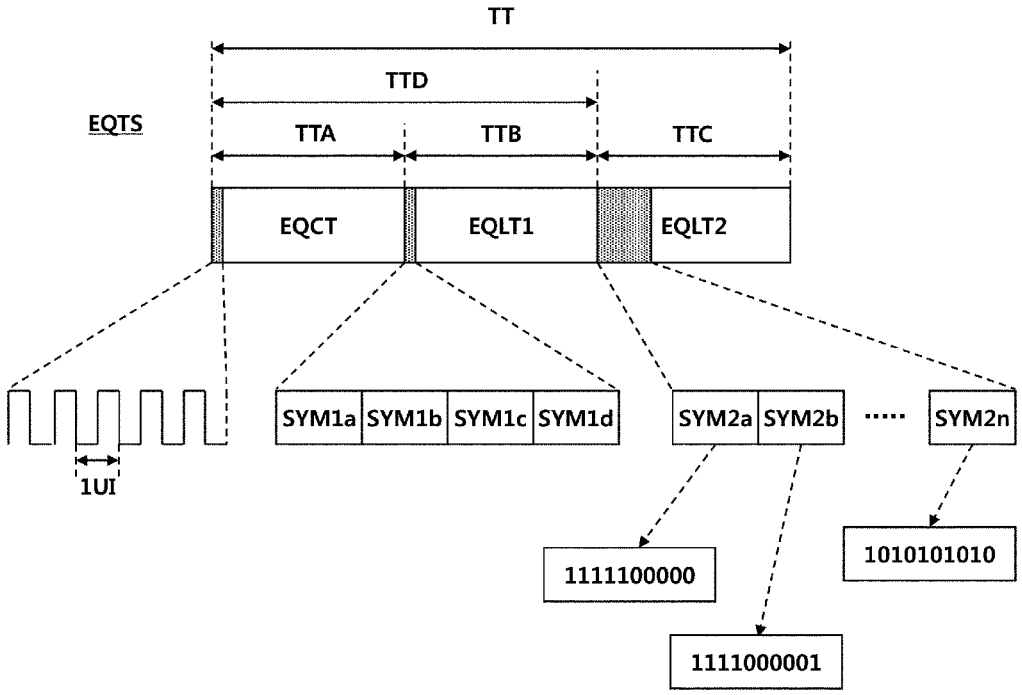
FIG. 16 is a diagram illustrating an example of the configuration of an EQ test signal according to an embodiment.

FIG. 16 is a diagram illustrating an example of the configuration of an EQ test signal according to an embodiment.

Referring to FIG. 16, the EQ test signal may include an EQ clock pattern (EQCT), a first EQ link data (EQLT1), and a second EQ link data (EQLT2).

The EQ clock pattern (EQCT) may have a pattern repeated in clock units (1 UI). The data driving device (e.g., the first communication unit) may train a clock and restore a first clock using the EQ clock pattern (EQCT).

The first EQ link data (EQLT1) may include a symbol set including three or four symbols. For example, the first EQ link data (EQLT1) may include a symbol set including four first type of symbols (SYM1*a*), (SYM1*b*), (SYM1*c*), and (SYM1*d*). This symbol set may be arranged to be repeated in the first EQ link data (EQLT1). In addition, the data driving device (e.g., the first communication unit) may train a link clock (e.g., the symbol clock and/or the pixel clock) using the first EQ link data (EQLT1).

The second EQ link data (EQLT2) may include a plurality of scrambled second type of symbols (SYM2*a*), (SYM2*b*), (SYM2*n*). The plurality of second type of symbols (SYM2*a*), (SYM2*b*), . . . , (SYM2*n*) may be DC-balanced zero symbols.

For a time (TT) m which one EQ test signal is transmitted, the EQ clock pattern (EQCT) may be transmitted for a first time (TTA), the first EQ link data (EQLT1) may be transmitted for a second time (11B) subsequent to the first time (TTA), and the second EQ link data (EQLT2) may be transmitted for a third time (TTC) subsequent to the second time (TTB).

The time (TT) during which the EQ test signal is transmitted may be equal to the frame time or 1/N of the frame active time.

Figure 17:
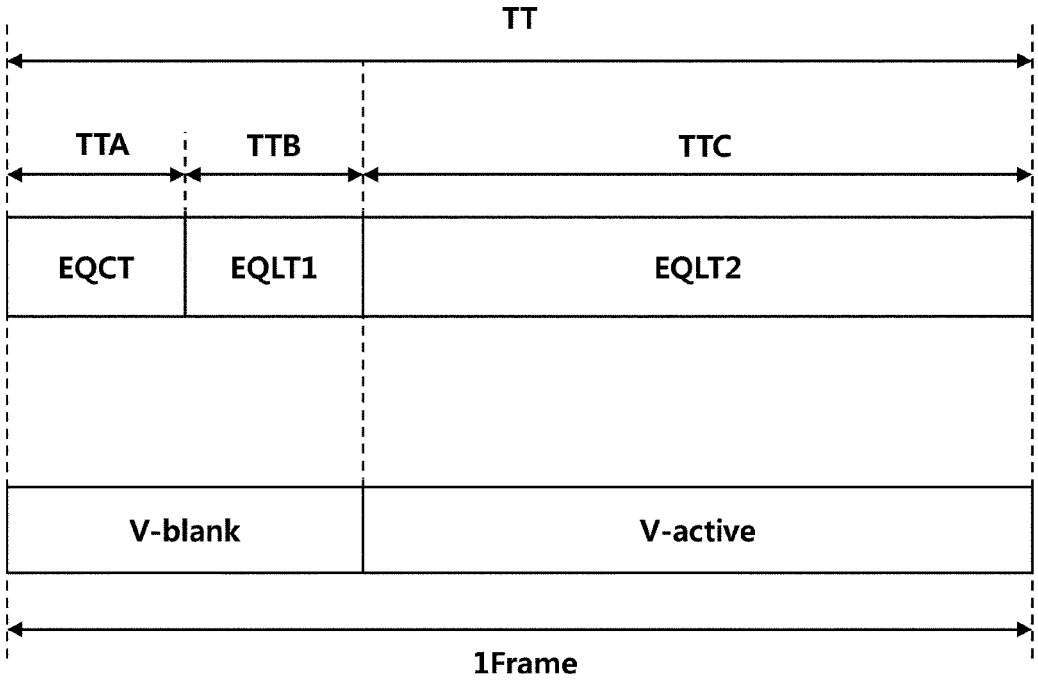
FIG. 17 is a diagram illustrating comparison of a time of an EQ test signal with a frame time according to a first example in an embodiment.

FIG. 17 is a diagram illustrating comparison of a time of an EQ test signal with a frame time according to a first example in an embodiment.

Referring to FIG. 17, a time (TT) for which the EQ test signal is transmitted may be equal to one frame time. In addition, a first time (TTA) for which the EQ clock pattern (EQCT) is transmitted and a second time (TBB) for which the first EQ link data (EQLT1) is transmitted may be included in a frame blank time period (V-blank), and a third time (TTC) for which the second EQ link data (EQLT2) is transmitted may be included in a frame active time period (V-active).

In addition, a plurality of EQ test signals may be periodically transmitted by the frame time unit according to the above time setting. According to the first example above, it is possible to more accurately compare the equalizer settings by providing all the EQ test signals with substantially the same environment.

Figure 18:
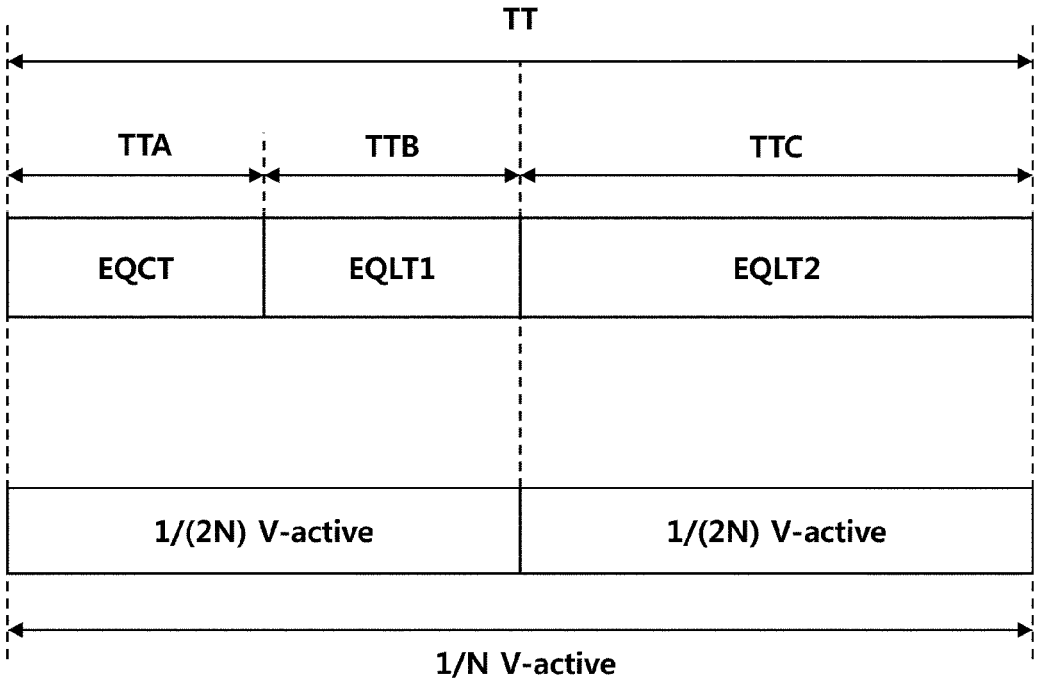
FIG. 18 is a diagram illustrating comparison of a time of an EQ test signal with a frame active time according to a second example in an embodiment.

FIG. 18 is a diagram illustrating comparison of a time of an EQ test signal with a frame active time according to a second example in an embodiment.

Referring to FIG. 18, a time (TT) during which the EQ test signal is transmitted may be equal to 1/N of a frame active time period (1/N V-active). In addition, a first time (TTA) for which the EQ clock pattern (EQCT) is transmitted and a second time (TBB) for which the first EQ link data (EQLT1) is transmitted may be included in 1/(2N) of the frame active time period {1/(2N) V-active}, and a third time (TTC) for which the second EQ link data (EQLT2) is transmitted may be included in the remaining 1/(2N) of the frame active time period {1/(2N) V-active}.

In addition, a plurality of EQ test signals may be periodically transmitted by the unit of 1/N of the frame active time period (1/N V-active) according to the above time setting. According to the first example above, it is possible to more accurately compare the equalizer settings by providing all the EQ test signals with substantially the same environment (i.e., the environment in which all the EQ test signals are transmitted during the frame active time period).

As described above, according to the present embodiment, it is possible to be speed up data communication in the display device. In addition, according to the present embodiment, information which can be transmitted through an existing main communication line can be transmitted through an auxiliary communication line. In addition, according to the present embodiment, information can be transmitted and received through the auxiliary communication line before the communication through the main communication line is established, thereby providing more effective data communication. In addition, according to the present embodiment, at least some information can be transmitted and received through a lock communication line for checking a clock training state. Further, according to the present embodiment, it is possible to automatically optimize the setting of the equalizer in the receiving device (e.g., the data driving device).

What is claimed is:

1. A data driving device comprising:

a first communication unit comprising an equalizer and configured to receive a first communication signal through a first communication line and to receive image data contained in the first communication signal;

a second communication unit configured to transmit and receive a second communication signal through a second communication line and to receive equalizer (EQ) test information on the equalizer through the second communication signal; and a controlling unit configured to control a setting of the equalizer according to the EQ test information, to evaluate a reception performance of the first communication unit using an EQ test signal received through the first communication line for each setting state of the equalizer, and to determine an optimal setting for the equalizer according to an evaluation result.

2. The data driving device of claim 1, wherein the EQ test information comprises a set value for a gain of the equalizer.

3. The data driving device of claim 1, wherein the EQ test signal comprises a clock pattern, the first communication unit restores a first clock using the clock pattern, and the controlling unit evaluates the reception performance of the first communication unit using a result of the restoration of the first clock.

4. The data driving device of claim 1, wherein the EQ test signal comprises link data and the controlling unit evaluates the reception performance of the first communication unit by a reception rate of a plurality of symbols included in the link data.

5. The data driving device of claim 4, wherein the link data comprises a plurality of direct current (DC)-balanced zero symbols and the controlling unit evaluates the reception performance of the first communication unit by a reception rate of the plurality of DC-balanced zero symbols.

6. The data driving device of claim 5, wherein the plurality of DC-balanced zero symbols are scrambled.

7. The data driving device of claim 4, wherein the link data comprises a plurality of first type symbols and a plurality of second type symbols, the first communication unit restores a symbol clock using the plurality of first type symbols and receives the plurality of second type symbols according to the symbol clock, and the controlling unit evaluates the reception performance of the first communication unit by a reception rate of the plurality of second type symbols.

8. The data driving device of claim 1, wherein the EQ test signal is received by a frame time unit.

9. The data driving device of claim 8, wherein the EQ test signal comprises a clock pattern and link data, the link data comprising a plurality of first type symbols and a plurality of second type symbols, and the first communication unit receives the clock pattern and the plurality of first type symbols during a frame blank time period of each frame and receives the plurality of second type symbols during a frame active time period of each frame.

10. The data driving device of claim 1, wherein the EQ test signal is received by a unit of 1/N of a frame active time period (N is a natural number of 2 or higher) and the first communication unit receives a total of N EQ test signals.

11. The data driving device of claim 10, wherein the EQ test signal comprises a clock pattern and link data, the link data comprising a plurality of first type symbols and a plurality of second type symbols, the first communication unit receives the clock pattern and the plurality of first type symbols during 1/(2N) of a frame active time period and receives the plurality of second type symbols during another 1/(2N) of the frame active time period.

12. The data driving device of claim 1, wherein the controlling unit determines an optimal set value for the equalizer and transmits the determined optimal set value to another device through the second communication signal.

13. The data driving device of claim 1, wherein the second communication unit receives a plurality of pieces of the EQ test information indicating different set values respectively during different time periods and the first communication unit receives each of the EQ test signals during a time period subsequent to the time period during which each piece of the EQ test information is received.

14. The data driving device of claim 1, wherein the first communication unit receives the EQ test signal within a time period before receiving the image data after starting and the controlling unit determines an optimal setting for the equalizer before the image data is received.

15. The data driving device of claim 1, wherein the second communication unit receives a state check command through the second communication signal before receiving the EQ test information and changes a voltage level of the second communication line for a predetermined time in response to the state check command.

16. The data driving device of claim 1, wherein the first communication unit restores a first clock from the first communication signal and receives the image data included in the first communication signal according to the first clock, and the second communication unit transmits a training state of the first clock through the second communication signal.

17. A data processing device comprising:

a controlling unit configured to process image data;

a first communication unit configured to include the image data in a first communication signal and to transmit the first communication signal to a data driving device connected thereto through a first communication line; and a second communication unit configured to transmit and receive a second communication signal to the data driving device through a second communication line and to transmit equalizer (EQ) test information on an equalizer of the data driving device through the second communication signal, wherein the controlling unit is configured to perform control such that the second communication unit transmits the EQ test information through the second communication signal and the first communication unit transmits an EQ test signal through the first communication signal in response to the transmission of the EQ test information.

18. The data processing device of claim 17, wherein the first communication line is a differential signal line driven by a current and the second communication line is a single signal line driven as an open drain, wherein a data rate of the first communication line is higher than that of the second communication line.

19. The data processing device of claim 17, wherein the EQ test signal is transmitted by a frame time unit or by a unit of 1/N of a frame active time period (N is a natural number of 2 or higher).

20. The data processing device of claim 19, wherein the controlling unit is configured to repeat periodic operations by the frame unit.

* * * * *